US007702514B2

(12) United States Patent
Lin et al.

(10) Patent No.: US 7,702,514 B2
(45) Date of Patent: Apr. 20, 2010

(54) ADJUSTMENT OF SCALE FACTORS IN A PERCEPTUAL AUDIO CODER BASED ON CUMULATIVE TOTAL BUFFER SPACE USED AND MEAN SUBBAND INTENSITIES

(75) Inventors: Chih-Hsin Lin, Hsinchu Hsien (TW); Hsin-Chia Chen, Hsinchu Hsien (TW); Chang-Che Tsai, Hsinchu Hsien (TW); Tzu-Yi Chao, Hsinchu Hsien (TW)

(73) Assignee: Pixart Imaging Incorporation, HsinChu (TW)

( * ) Notice: Subject to any disclaimer, the term of this patent is extended or adjusted under 35 U.S.C. 154(b) by 1058 days.

(21) Appl. No.: 11/391,752

(22) Filed: Mar. 28, 2006

(65) Prior Publication Data

US 2007/0033021 A1 Feb. 8, 2007

(30) Foreign Application Priority Data

Jul. 22, 2005 (TW) ..... 94124914 A

(51) Int. Cl.
*G10L 19/02* (2006.01)

(52) U.S. Cl. ..... 704/500; 704/200.1

(58) Field of Classification Search ..... None
See application file for complete search history.

(56) References Cited

U.S. PATENT DOCUMENTS 5,825,310 A * 10/1998 Tsutsui ..... 341/51
6,199,038 B1 * 3/2001 Tsutsui ..... 704/229
6,405,338 B1 * 6/2002 Sinha et al. ..... 714/752
6,678,653 B1 * 1/2004 Tsushima et al. ..... 704/220
7,181,079 B2 * 2/2007 Herre et al. ..... 382/251
7,409,350 B2 * 8/2008 Hsu ..... 704/501
2004/0158456 A1 * 8/2004 Prakash et al. ..... 704/200.1

* cited by examiner

*Primary Examiner*—Talivaldis Ivars Smits
(74) *Attorney, Agent, or Firm*—Tung & Associates

(57) ABSTRACT

A method for audio encoding includes: analyzing an audio frame using a psychoacoustic model to obtain a corresponding masking curve and window information; transforming the audio frame according to the window information to obtain a spectrum, and dividing the spectrum into a plurality of frequency sub-bands; estimating a scale factor for each frequency sub-band; quantizing the frequency sub-bands; encoding the quantized frequency sub-bands; and packing the encoded frequency sub-bands and side information into an audio stream. Each scale factor is estimated based on a quantizable audio intensity of each frequency sub-band, which is adjusted according to a cumulative total amount of buffer space used for storing the encoded frequency sub-bands and an amount of buffer space used for storing a previously encoded audio frame, and a mean of intensities of all signals in the corresponding frequency sub-band and spectrum position of the corresponding frequency sub-band.

32 Claims, 7 Drawing Sheets

ADJUSTMENT OF SCALE FACTORS IN A PERCEPTUAL AUDIO CODER BASED ON CUMULATIVE TOTAL BUFFER SPACE USED AND MEAN SUBBAND INTENSITIES

CROSS-REFERENCE TO RELATED APPLICATION

This application claims priority of Taiwanese Application No. 094124914, filed on Jul. 22, 2005.

BACKGROUND OF THE INVENTION

1. Field of the Invention

The invention relates to an apparatus and method for audio encoding, more particularly to an apparatus and method for audio encoding without performing loop computations.

2. Description of the Related Art

For conventional audio encoding methods, reference can be made to U.S. Patent Application Publication No. 20040143431. Referring to FIG. 1, in the aforesaid patent application, a conventional audio encoding system 10, which is described in the Description of the Related Art therein, includes a Modified Discrete Cosine Transform (MDCT) module 12, a psychoacoustic model 14, a quantization module 16, an encoding module 18, and a packing module 19.

A Pulse Code Modulation (PCM) sample, which is also referred to as an audio frame, is inputted into the MDCT module 12 and the psychoacoustic model 14. The psychoacoustic model 14 analyzes the PCM sample to obtain a masking curve and a window message corresponding thereto. From a range defined by the masking curve, a range of audio signals perceivable by the human ear can be observed. The human ear can perceive only audio signals the intensities of which are larger than the masking curve.

The MDCT module 12 performs MDCT on the PCM sample according to the window message transmitted from the psychoacoustic model 14 so as to obtain a plurality of transformed MDCT samples. The MDCT samples are grouped into a plurality of frequency sub-bands having non-equivalent bandwidths according to the auditory characteristics of the human ear. Each frequency sub-band has a masking threshold.

The quantization module 16 and the encoding module 18 perform a bit allocation process on each frequency sub-band repeatedly to determine an optimum scale factor and a stepsize factor. Based on the scale factor and the stepsize factor, the encoding module 18 encodes each frequency sub-band using the Huffman coding. It is noted that the encoding based on the scale factor and the stepsize factor requires all the MDCT samples in each frequency sub-band to conform to the encoding distortion standard. That is, the final encoding distortion of each MDCT sample should be lower than the masking threshold determined by the psychoacoustic model 14 within a limited number of available bits.

After encoding by the encoding module 18, all the encoded frequency sub-bands are combined via the packing module 19 for packing with corresponding side information so as to obtain a final audio stream. The side information contains information related to the encoding procedure, such as window messages, stepsize factor information, etc.

Referring to FIG. 2, the bit allocation process performed by the quantization module 16 and the encoding module 18 includes the following steps:

Step 300: Start the bit allocation process.

Step 302: Quantize disproportionately all the frequency sub-bands according to a stepsize factor of the audio frame.

Step 304: Look up in a Huffman Table to calculate the number of bits required for encoding all the MDCT samples in each frequency sub-band under a distortionless state.

Step 306: Determine whether the required number of bits is lower than the number of available bits. If yes, go to step 310. If no, go to step 308.

Step 308: Increase the value of the stepsize factor, and repeat step 302.

Step 310: De-quantize the quantized frequency sub-bands.

Step 312: Calculate the distortion of each frequency sub-band.

Step 314: Store a scale factor of each frequency sub-band and the stepsize factor of the audio frame.

Step 316: Determine whether the distortion of any frequency sub-band is higher than the masking threshold. If no, go to step 322. If yes, go to step 317.

Step 317: Determine whether there are other termination conditions, e.g., the scale factor has reached an upper limit, that have been met. If no, go to step 318. If yes, go to step 320.

Step 318: Increase the value of the scale factor.

Step 319: Amplify all the MDCT samples in the frequency sub-band according to the scale factor, and go to step 302.

Step 320: Determine whether the scale factor and the stepsize factor are optimum values. If yes, go to step 322. If no, go to step 321.

Step 321: Adopt the previously recorded optimum value, and go to step 322.

Step 322: End the bit allocation process.

The above bit allocation process primarily includes two loops. One is from step 302 to step 308, and is generally referred to as a bit rate control loop, which is used for determining the stepsize factor. The other is from step 302 to step 322, and is generally referred to as a distortion control loop, which is used for determining the scale factor. To complete one bit allocation process, it generally requires the execution of many distortion control loops, and each distortion control loop requires execution of many bit rate control loops, thereby resulting in reduced efficiency.

FIG. 3 illustrates a method proposed in the aforesaid U.S. patent publication to improve efficiency of the bit allocation process. The proposed bit allocation process includes the following steps:

Step 400: Start the bit allocation process.

Step 402: Execute a scale factor prediction method so that each frequency sub-band generates a corresponding scale factor.

Step 404: Execute a stepsize factor prediction method to generate a predicted stepsize factor of an audio frame.

Step 406: Quantize each frequency sub-band according to the predicted stepsize factor.

Step 408: Encode each quantized frequency sub-band using an encoding scheme.

Step 410: Determine whether a predetermined bit value is used most efficiently according to a determination criterion. If yes, go to step 414. If no, go to step 412.

Step 412: Adjust the value of the predicted stepsize factor, and repeat step 406.

Step 414: End the bit allocation process.

Although the process proposed in the aforesaid patent publication can simplify the number of loops, it still contains one primary loop (i.e., from steps 406 to 412). Besides, steps 402 and 404 actually further include many sub-steps. Therefore, the process proposed in the aforesaid patent publication still cannot eliminate loop computations, and cannot achieve better efficiency in audio encoding. In addition, in realizing the hardware for the audio encoding system, effective control may not be achieved due to the presence of the loop.

SUMMARY OF THE INVENTION

Therefore, an object of the present invention is to provide an audio encoding apparatus capable of faster processing speeds.

Another object of the present invention is to provide an audio encoding method without requiring loop computation.

Accordingly, the audio encoding apparatus of the present invention is adapted to encode an audio frame into an audio stream. The audio encoding apparatus includes a psychoacoustic module, a transform module, an encoding module, a quantization module, and a packing module. The encoding module includes an encoding unit and a buffer-unit. The quantization module includes a scale factor estimation unit and a quantization unit.

The psychoacoustic module is adapted to receive and analyze the audio frame using a psychoacoustic model so as to obtain a corresponding masking curve and window information. The transform module is connected to the psychoacoustic module, receives the window information and the audio frame, is adapted to transform the audio frame from the time domain to the frequency domain according to the window information so as to obtain a spectrum of the audio frame, and divides the spectrum into a plurality of frequency sub-bands.

The encoding unit is for encoding quantized frequency sub-bands. The buffer unit is for storing encoded frequency sub-bands.

The scale factor estimation unit is connected to the transform module and the buffer unit, adjusts a quantizable audio intensity of each of the frequency sub-bands in a current audio frame according to a cumulative total buffer utilization amount, which is the total amount of buffer space that has been used thus far for storing the encoded frequency sub-bands in the buffer unit, and an amount of buffer space used for storing a previously encoded audio frame in the buffer unit, further adjusts the quantizable audio intensity of each of the frequency sub-bands in the current audio-frame according to a mean of the intensities of all signals in the corresponding frequency sub-band in the current audio frame and position of the corresponding frequency sub-band in the current audio frame in the spectrum, and estimates a scale factor for each of the frequency sub-bands in the current audio frame according to finally adjusted quantizable audio intensities of the frequency sub-bands in the current audio frame.

The quantization unit is connected to the scale factor estimation unit and the encoding unit, and quantizes each of the frequency sub-bands in the current audio frame according to the corresponding scale factor obtained by the scale factor estimation unit for subsequent transmission of the quantized frequency sub-bands to the encoding unit. The packing module is connected to the encoding module, and packs the encoded frequency sub-bands in the buffer unit and side information into the audio stream.

A method for audio encoding according to the present invention includes the following steps:

(A) analyzing an audio frame using a psychoacoustic model so as to obtain a corresponding masking curve and window information;

(B) transforming the audio frame from the time domain to the frequency domain based on the window information so as to obtain a spectrum of the audio frame, and dividing the spectrum into a plurality of frequency sub-bands;

(C) estimating a scale factor for each of the frequency sub-bands in the audio frame;

(D) quantizing each of the frequency sub-bands according to the scale factor thereof;

(E) encoding the quantized frequency sub-bands; and (F) packing the encoded frequency sub-bands and side information into an audio stream, wherein steps (C), (D) and (E) belong to a bit allocation process, and the estimation of the scale factor for each of the frequency sub-bands in step (C) includes the following sub-steps:

(1) adjusting a quantizable audio intensity of each of the frequency sub-bands in a current audio frame according to a cumulative total buffer utilization amount, which is the total amount of buffer space that has been used thus far for storing the encoded frequency sub-bands in a buffer unit at an encoding end, and an amount of buffer space used for storing a previously encoded audio frame in the buffer unit;

(2) further adjusting the quantizable audio intensity of each of the frequency sub-bands in the current audio frame according to a mean of the intensities of all signals in the corresponding frequency sub-band in the current audio frame;

(3) further adjusting the quantizable audio intensity of each of the frequency sub-bands in the current audio frame according to position of the corresponding frequency sub-band in the current audio frame in the spectrum; and (4) estimating the scale factor for each of the frequency sub-bands in the current audio frame according to finally adjusted quantizable audio intensities of the frequency sub-bands in the current audio frame.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
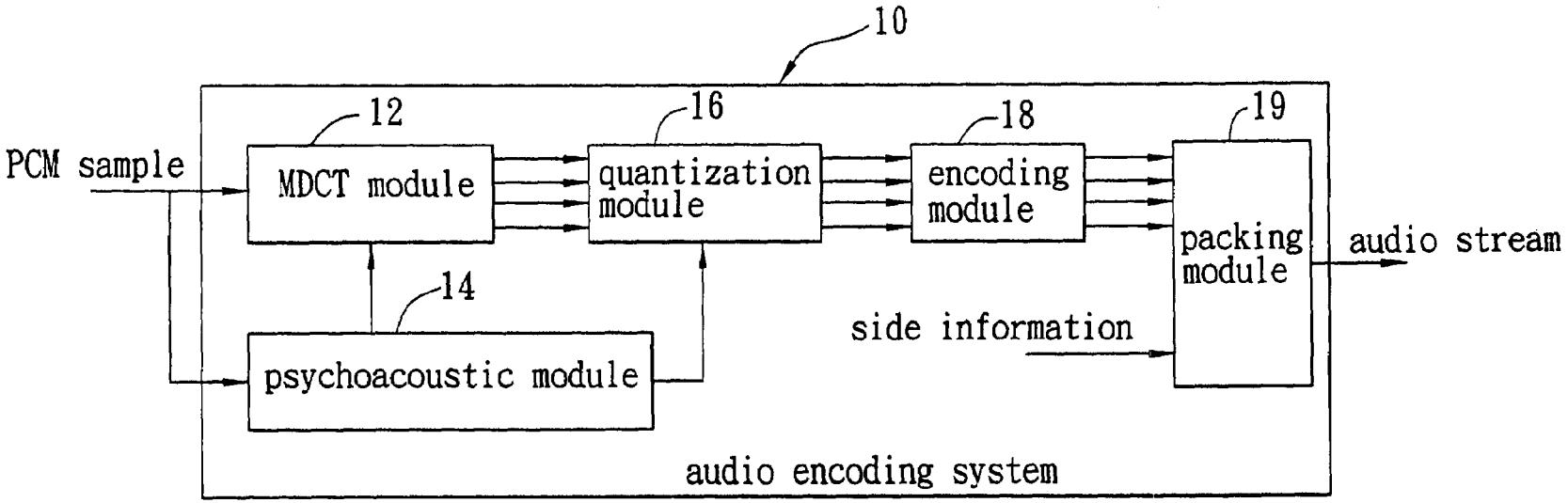
FIG. 1 PRIOR ART
FIG. 1 is a block diagram of a conventional audio encoding system.
Figure 2:
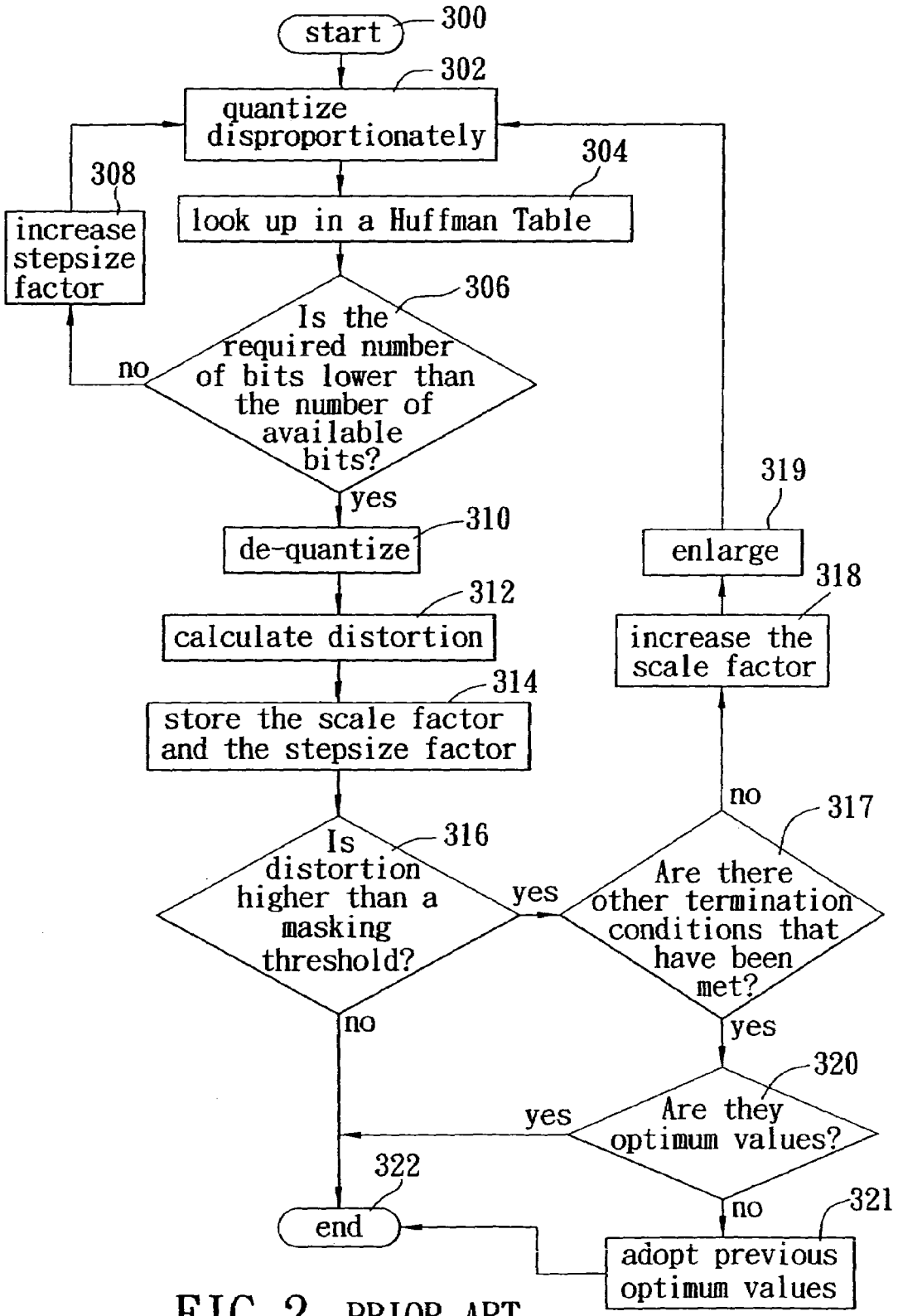
FIG. 2 PRIOR ART
FIG. 2 is a flowchart of a bit allocation process employed by the conventional audio encoding system.
Figure 3:
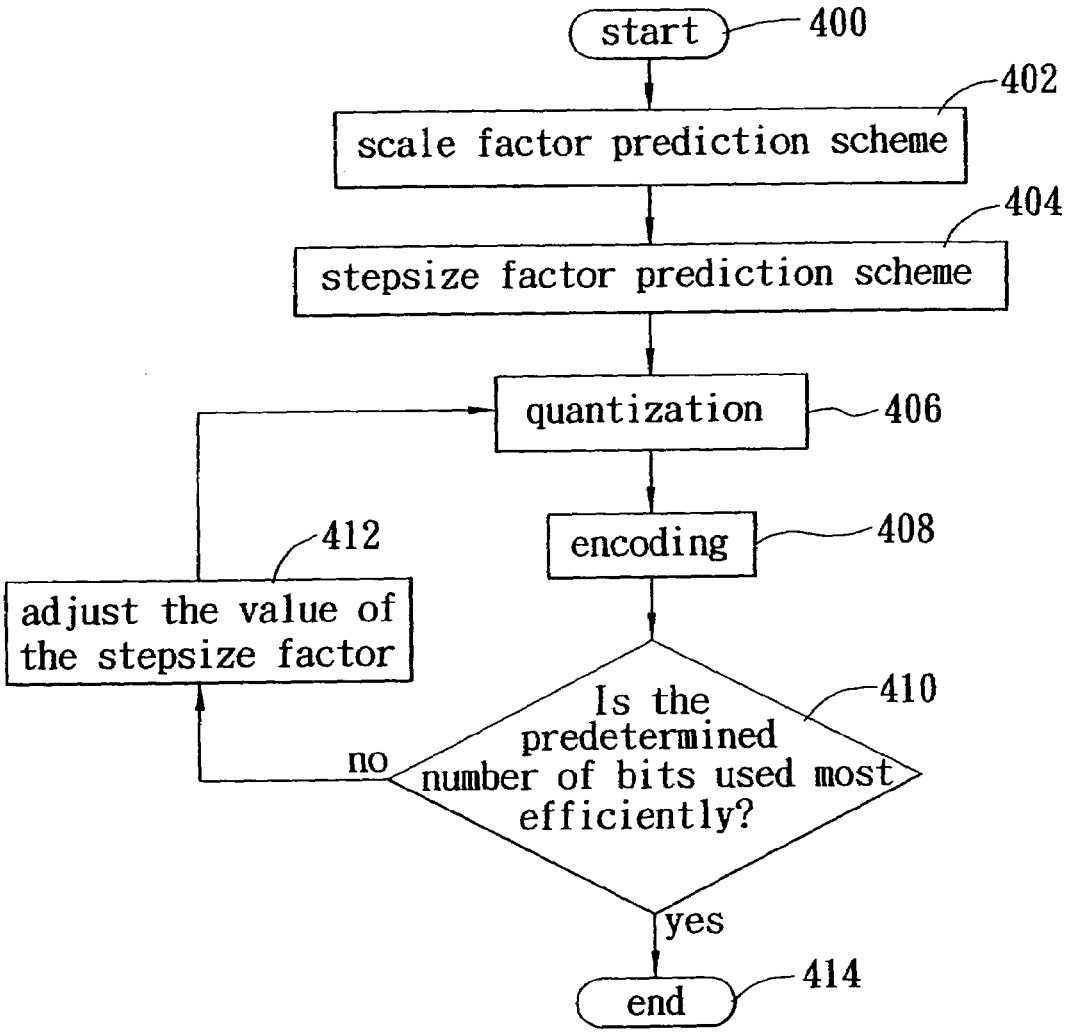
FIG. 3 PRIOR ART
FIG. 3 illustrates another conventional bit allocation process.
Figure 4:
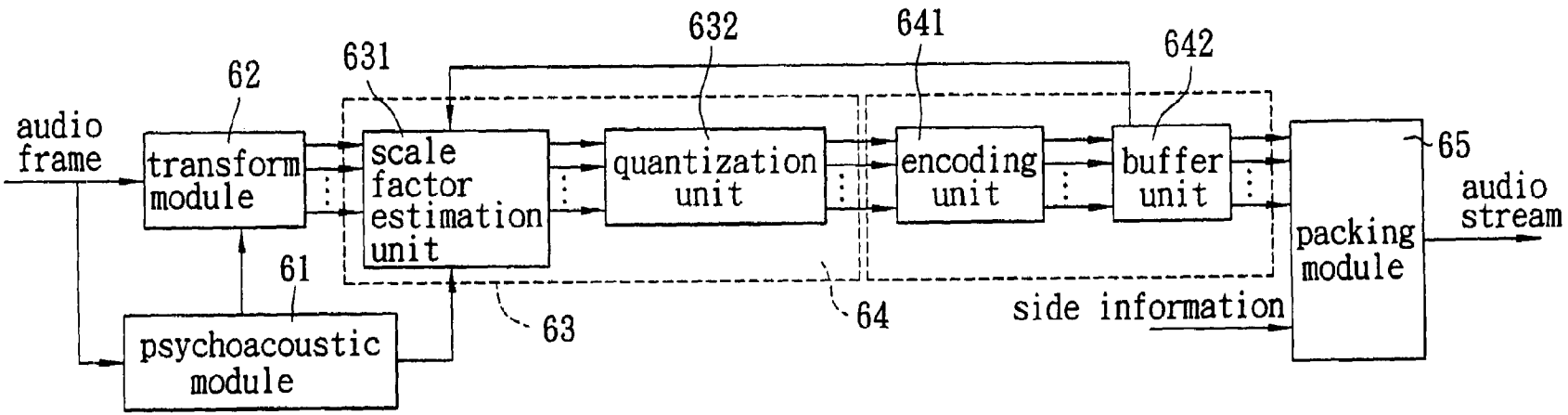
FIG. 4 is a system block diagram of a preferred embodiment of an audio encoding apparatus according to the present invention.

Referring to FIG. 4, the preferred embodiment of an audio encoding apparatus according to the present invention is adapted for encoding an audio frame into an audio stream, and includes a psychoacoustic module 61, a transform module 62, a quantization module 63, an encoding module 64, and a packing module 65. The quantization module 63 includes a scale factor estimation unit 631 and a quantization unit 632. The encoding module 64 includes an encoding unit 641 and a buffer unit 642.

The psychoacoustic module 61 is identical to that of the prior art, and can analyze the audio frame using a psychoacoustic model so as to obtain a corresponding masking curve and window information. The range of signals discernible by the human ear can be known from the range defined by the masking curve, and only audio signals intensities of which are larger than the masking curve can be perceived by the human ear.

The transform module 62 is connected to the psychoacoustic module 61, and receives the window information and masking curve sent therefrom. The transform module 62 also receives the audio frame, and transforms the audio frame from the time domain to the frequency domain according to the window information so as to obtain a spectrum of the audio frame. The transform module 62 then divides the spectrum into a plurality of frequency sub-bands. According to the masking curve, each of the frequency sub-bands has a masking threshold. In this embodiment, the transform scheme used by the transform module 62 is a known modified discrete cosine transform. However, the transform module 62 may employ other discrete cosine transforms not limited to the above.

The encoding unit 641 of the encoding module 64 is capable of encoding quantized frequency sub-bands. The buffer unit 642 stores the encoded frequency sub-bands. When a cumulative total buffer utilization amount, i.e., the total amount of buffer space that has been used thus far for storing the encoded frequency sub-bands in the buffer unit 642, is greater than a predicted cumulative amount for a current audio frame, this indicates that the buffer unit 642 is in an overutilized state. When the cumulative total buffer utilization amount is smaller than the predicted cumulative amount for the current audio frame, this indicates that the buffer unit 642 is in an underutilized state.

The scale factor estimation unit 631 of the quantization module 63 is connected to the transform module 62 and the buffer unit 642, and is capable of adjusting a quantizable audio intensity $X_{max}$ of each of the frequency sub-bands in a current audio frame according to the cumulative total buffer utilization amount and an amount of buffer space used for storing a previously encoded audio frame in the buffer unit 642.

The scheme of adjustment is described as follows: In a scenario where an audio frame (assumed to be an $n^{th}$ audio frame) that has been processed by the transform module 62 is to be processed by the scale factor estimation unit 631, the buffer unit 642 is in an overutilized state, and the amount of buffer space used for storing the previously encoded audio frame (i.e., the $(n-1)^{th}$ audio frame) is higher than an average amount of buffer space usable for storing a single encoded audio frame, the scale factor estimation unit 631 will down-adjust the quantizable audio intensity $X_{max}$ to reduce the amount of buffer space used for the $n^{th}$ audio frame so as to achieve the object of reducing quantization quality for increasing compression rate. On the other hand, in a scenario where the buffer unit 642 is in an overutilized state but the amount of buffer space used for storing the previously encoded audio frame is lower than the average amount of buffer space usable for storing a single encoded audio frame, the scale factor estimation unit 631 will not adjust the quantizable audio intensity $X_{max}$.

In addition, if the buffer unit 642 is in an underutilized state, and the amount of buffer space used for storing the previously encoded audio frame (i.e., the $(n-1)^{th}$ audio frame) is lower than the average amount of buffer space usable for storing a single encoded audio frame, the scale factor estimation unit 631 will up-adjust the quantizable audio intensity $X_{max}$ to increase the amount of buffer space used for storing the $n^{th}$ audio frame so as to achieve the object of enhanced quantization quality. Moreover, when the buffer unit 642 is in an underutilized state while the amount of buffer space used for storing the previously encoded audio frame is higher than the average amount of buffer space usable for storing a single encoded audio frame, the scale factor estimation unit 631 will not adjust the quantizable audio intensity $X_{max}$.

The scale factor estimation unit 631 further adjusts the quantizable audio intensity $X_{max}$ of each of the frequency sub-bands in the current audio frame based on a mean of the intensities of all signals in the corresponding frequency sub-band in the current audio frame. That is, the quantizable audio intensity $X_{max}$ is up-adjusted when the mean of the intensities of signals in the corresponding frequency sub-band is large, and is down-adjusted when otherwise.

In addition, since the human ear is more sensitive to low-frequency signals, the scale factor estimation unit 631 further adjusts the quantizable audio intensity $X_{max}$ of each of the frequency sub-bands in the current audio frame based on position of the corresponding frequency sub-band in the current audio frame in the spectrum. That is, the quantizable audio intensity $X_{max}$ is up-adjusted if the corresponding frequency sub-band is located at a forward position (i.e., the frequency sub-band belongs to a low-frequency signal) in the spectrum, and is down-adjusted when otherwise.

After the scale factor estimation unit 631 has made certain the quantizable audio intensity $X_{max}$ of each of the frequency sub-bands in the current audio frame, the scale factor (SF) for each of the frequency sub-bands in the current audio frame is estimated according to the following equations (1) and (2).

$$SF = -\frac{16}{3}[C_1\log_2(X') + C_2\log_2(X_{\max})] \quad \text{equation (1)}$$

$$X' = f(X^{3/4}) \quad \text{equation (2)}$$

where $C_1$ and $C_2$ in equation (1) are constant parameters, that are selected depending on use requirements so that the final encoding distortion of the frequency sub-bands can be below the masking threshold within a limited number of usable bits; and X in equation (2) is a vector representing the intensity of each signal in the corresponding frequency sub-band. In this embodiment, the function $f(.)$ may be max(.) In this case, X' is a maximum of absolute values of the intensities of the signals in the corresponding frequency sub-band to the power of ¾. The function $f(.)$ may also be mean(.), which means that X' is a mean of absolute values of the intensities of the signals in the corresponding frequency sub-band to the power of ¾. It is noted that $f(.)$ may also be any other functions not limited to the above.

The quantization unit 632 is connected to the scale factor estimation unit 631 and the encoding unit 641. The quantization unit 632 quantizes the frequency sub-bands in the current audio frame according to the corresponding scale factor (SF) obtained by the scale factor estimation unit 631, and sends the quantized frequency sub-bands to the encoding unit 641.

The packing module 65 is connected to the encoding module 64, and, like the prior art, packs the encoded frequency sub-bands in the buffer unit 642 and side information into an audio stream. The side information contains information related to the encoding process, such as window information, scale factors, etc.

Figure 5:
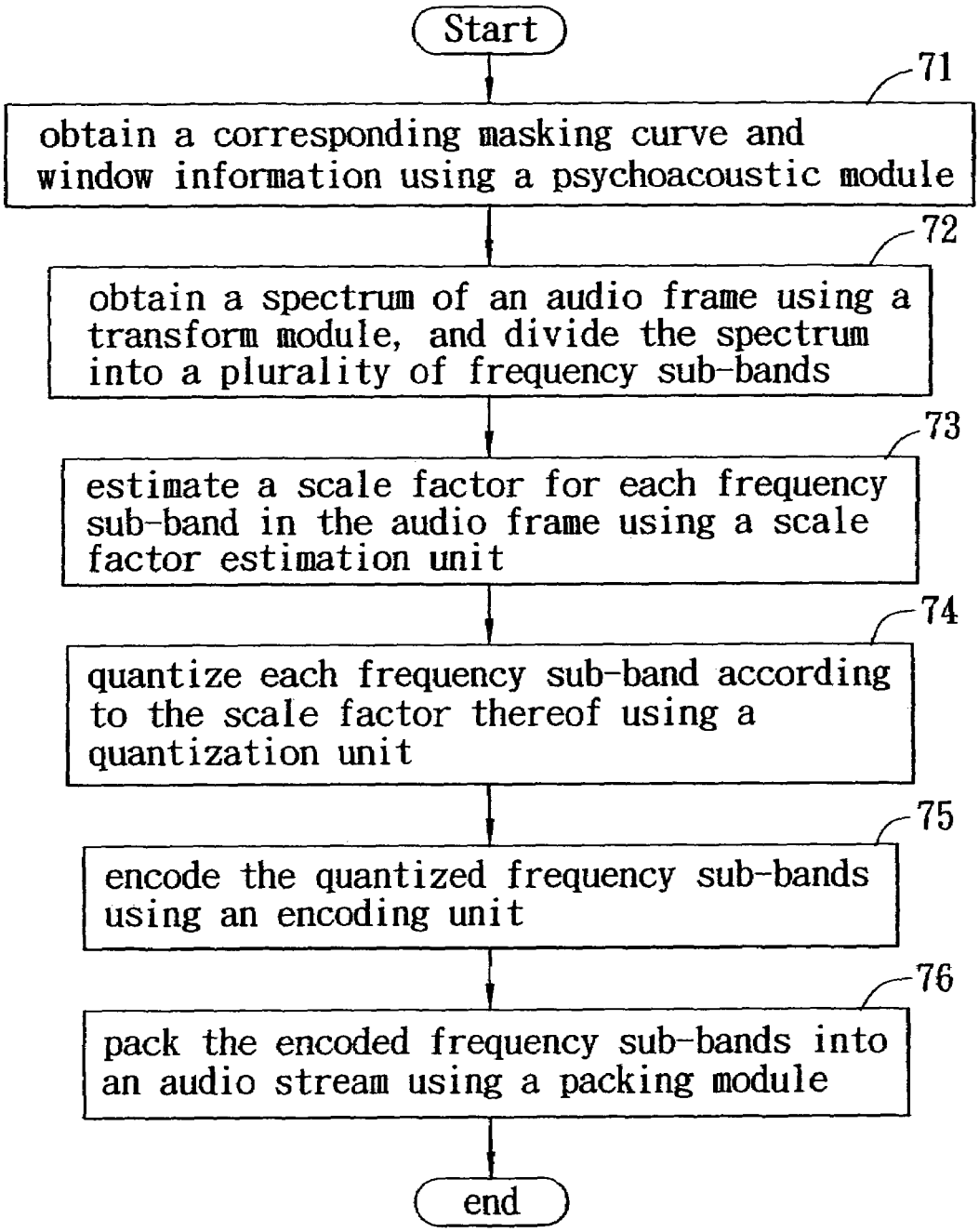
FIG. 5 is a flowchart of a preferred embodiment of a method for audio encoding according to the present invention.

Referring to FIG. 5, the preferred embodiment of a method for audio encoding according to the present invention is shown to include the following steps.

In step 71, the psychoacoustic module 61 analyzes an audio frame using a psychoacoustic model so as to obtain a corresponding masking curve and window information.

In step 72, the transform module 62 transforms the audio frame from the time domain to the frequency domain based on the window information so as to obtain a spectrum of the audio frame, and divides the spectrum into a plurality of frequency sub-bands.

In step 73, the scale factor estimation unit 631 estimates directly the scale factor (SF) for each of the frequency sub-bands in the audio frame according to a predetermined principle.

In step 74, the quantization unit 632 quantizes each of the frequency sub-bands according to the scale factors (SF) of the frequency sub-bands.

In step 75, the encoding unit 641 encodes the quantized frequency sub-bands.

In step 76, the packing module 65 packs the encoded frequency sub-bands in the buffer unit 642 and side information into an audio stream.

Steps 73 to 75 belong to a bit allocation process.

Figure 6:
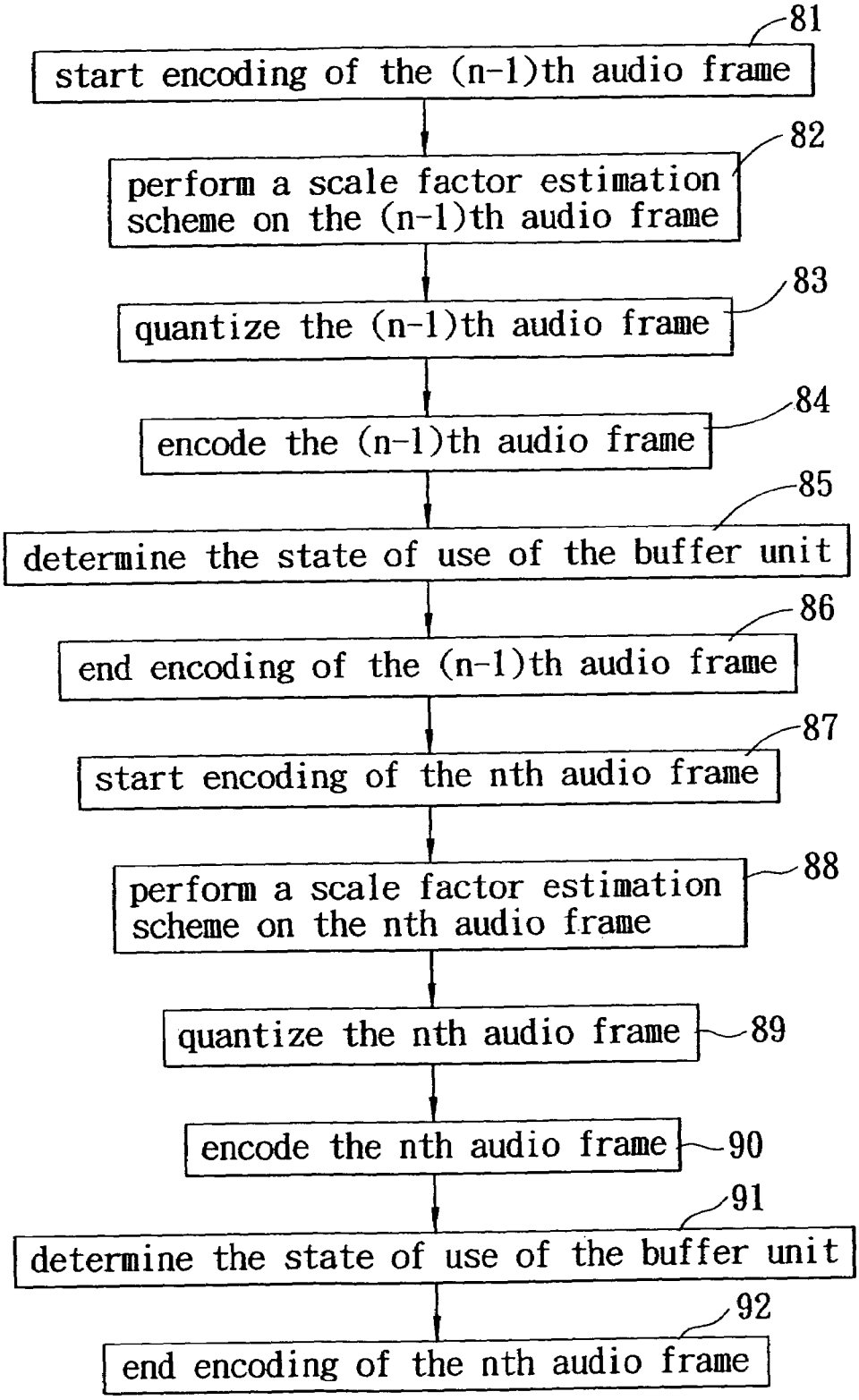
FIG. 6 is a flowchart illustrating a bit allocation process of the preferred embodiment.

With reference to FIG. 6, the bit allocation process in the method for audio encoding according to the present invention is shown to include the following steps.

In step 81, encoding of the $(n-1)^{th}$ audio frame starts.

In step 82, the scale factor estimation unit 631 performs a scale factor estimation scheme on the $(n-1)^{th}$ audio frame.

In step 83, the quantization unit 632 quantizes the $(n-1)^{th}$ audio frame.

In step 84, the encoding unit 641 encodes the $(n-1)^{th}$ audio frame.

In step 85, the state of use of the buffer unit 642 is determined.

In step 86, the encoding of the $(n-1)^{th}$ audio frame is ended.

In step 87, encoding of the $n^{th}$ audio frame starts.

In step 88, the scale factor estimation unit 631 performs a scale factor estimation scheme on the $n^{th}$ audio frame according to the state of use of the buffer unit 642 determined in step 85.

In step 89, the quantization unit 632 quantizes the $n^{th}$ audio frame.

In step 90, the encoding unit 641 encodes the $n^{th}$ audio frame.

In step 91, the state of use of the buffer unit 642 is determined.

In step 92, encoding of the $n^{th}$ audio frame is ended. Thereafter, a next audio frame is processed in the same manner as described above.

Figure 7:
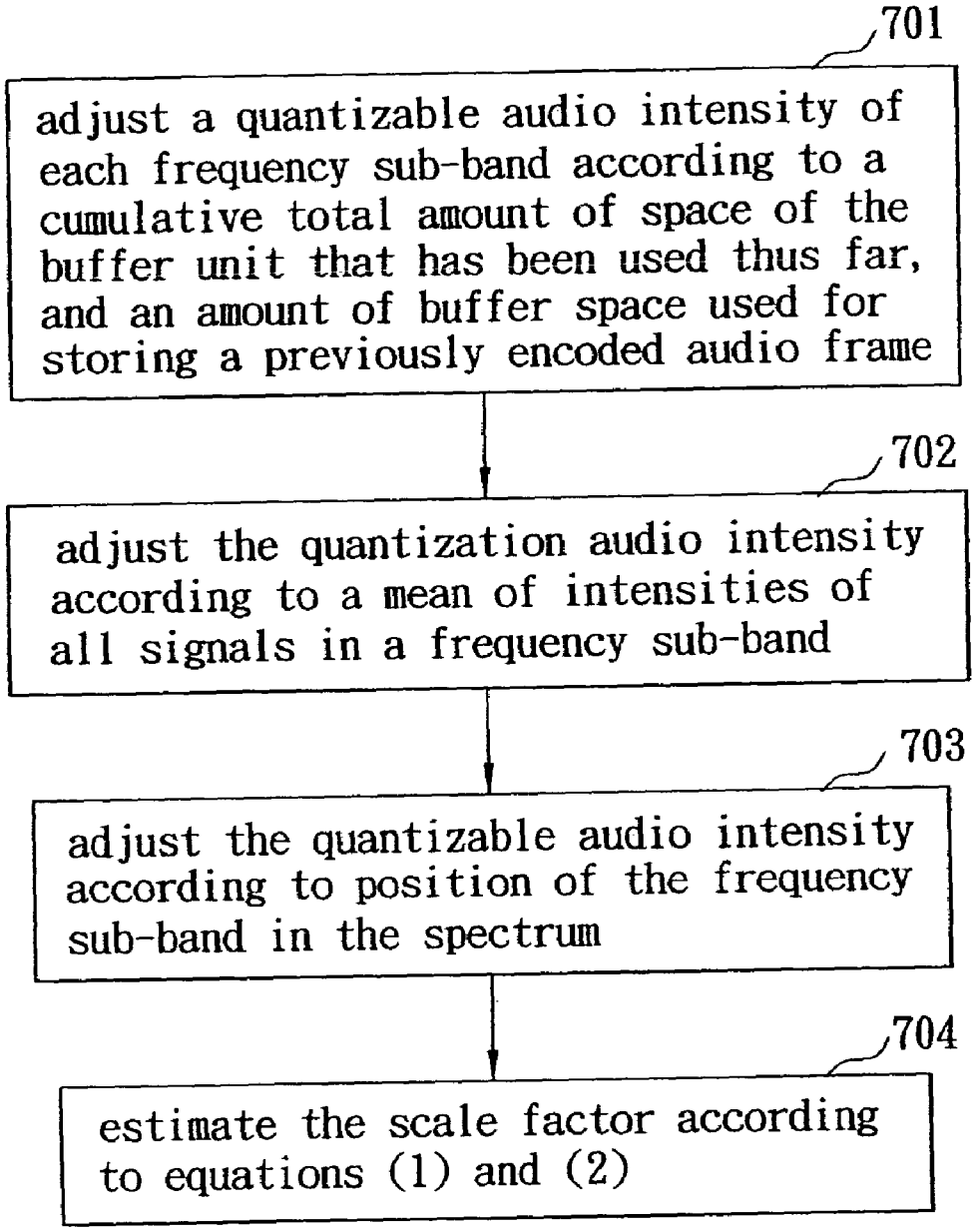
FIG. 7 is a flowchart illustrating a scale factor estimation scheme of the preferred embodiment.

Referring to FIG. 7, the scheme of estimating the scale factor (SF) of each frequency sub-band in the current audio frame as employed by the scale factor estimation unit 631 is shown to include the following steps.

In step 701, the scale factor estimation unit 631 adjusts a quantizable audio intensity $X_{max}$ of each frequency sub-band according to a cumulative total amount of space of the buffer unit 642 that has been used thus far, and an amount of buffer space used for storing a previously encoded audio frame.

In step 702, the scale factor estimation unit 631 further adjusts the quantizable audio intensity $X_{max}$ of each frequency sub-band according to a mean of the intensities of all signals in the corresponding frequency sub-band in the current audio frame.

In step 703, the scale factor estimation unit 631 further adjusts the quantizable audio intensity $X_{max}$ of each frequency sub-band according to position of the corresponding frequency sub-band in the current audio frame in the spectrum.

In step 704, the scale factor estimation unit 631 estimates the scale factors (SF) according to equations (1) and (2).

It is noted that steps 701-703 may be performed in any arbitrary order, and are not necessarily executed in the disclosed sequence.

In sum, with the scale factor estimation unit 631 of this invention, preferred scale factors (SF) can be obtained by executing step 73 once for each audio frame, unlike the prior art which requires repeated execution of one loop or even two loops, thereby effectively reducing computational time and enhancing operational efficiency. Besides, the absence of loops in the design of the flow simplifies hardware implementation.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. An audio encoding apparatus adapted for encoding an audio frame into an audio stream, said audio encoding apparatus comprising:

a psychoacoustic module adapted for receiving and analyzing the audio frame using a psychoacoustic model so as to obtain a corresponding masking curve and window information;

a transform module connected to said psychoacoustic module for receiving the window information, adapted for receiving and transforming the audio frame from the time domain to the frequency domain according to the window information so as to obtain a spectrum of the audio frame, and capable of dividing the spectrum into a plurality of frequency sub-bands;

an encoding module including an encoding unit for encoding quantized frequency sub-bands, and a buffer unit for storing encoded frequency sub-bands;

a quantization module including a scale factor estimation unit connected to said transform module and said buffer unit for estimating a scale factor for each of the frequency sub-bands in a current audio frame, and a quantization unit connected to said scale factor estimation unit and said encoding unit for quantizing each of the frequency sub-bands in the current audio frame according to the corresponding scale factor obtained by said scale factor estimation unit, said quantization unit transmitting the quantized frequency sub-bands to said encoding unit; and a packing module connected to said encoding module for packing the encoded frequency sub-bands in said buffer unit and side information into the audio stream, wherein said scale factor estimation unit adjusts a quantizable audio intensity of each of the frequency sub-bands in the current audio frame according to a cumulative total buffer utilization amount, which is the total amount of buffer space that has been used thus far for storing the encoded frequency sub-bands in said buffer unit, and an amount of buffer space used for storing a previously encoded audio frame in said buffer unit; and wherein said scale factor estimation unit estimates the scale factor for each of the frequency sub-bands in the current audio frame according to finally adjusted quantizable audio intensities of the frequency sub-bands in the current audio frame.

2. The audio encoding apparatus as claimed in claim 1, wherein:

when the cumulative total buffer utilization amount is greater than a predicted cumulative amount for the current audio frame, and when the amount of buffer space used for storing the previously encoded audio frame in said buffer unit is higher than an average amount of buffer space usable for storing a single encoded audio frame, said scale factor estimation unit down-adjusts the quantizable audio intensity so as to reduce the amount of buffer space used for the current audio frame; and when the cumulative total buffer utilization amount is greater than the predicted cumulative amount, and when the amount of buffer space used for storing the previously encoded audio frame in said buffer unit is lower than the average amount of buffer space usable for storing a single encoded audio frame, said scale factor estimation unit does not adjust the quantizable audio intensity.

3. The audio encoding apparatus as claimed in claim 1, wherein:

when the cumulative total buffer utilization amount is less than a predicted cumulative amount for the current audio frame and when the amount of buffer space used for storing the previously encoded audio frame in said buffer unit is lower than an average amount of buffer space usable for storing a single encoded audio frame, said scale factor estimation unit up-adjusts the quantizable audio intensity so as to increase the amount of buffer space used for the current audio frame; and when the cumulative total buffer utilization amount is less than the predicted cumulative amount, and when the amount of buffer space used for storing the previously encoded audio frame in said buffer unit is higher than the average amount of buffer space usable for storing a single encoded audio frame, said scale factor estimation unit does not adjust the quantizable audio intensity.

4. The audio encoding apparatus as claimed in claim 1, wherein said scale factor estimation unit further adjusts the quantizable audio intensity of each of the frequency sub-bands in the current audio frame according to a mean of the intensities of all signals in the corresponding frequency sub-band in the current audio frame.

5. The audio encoding apparatus as claimed in claim 4, wherein said scale factor estimation unit up-adjusts the quantizable audio intensity when the mean of the intensities of all signals in the corresponding frequency sub-band in the current audio frame is large.

6. The audio encoding apparatus as claimed in claim 4, wherein said scale factor estimation unit down-adjusts the quantizable audio intensity when the mean of the intensities of all signals in the corresponding frequency sub-band in the current audio frame is not large.

7. The audio encoding apparatus as claimed in claim 4, wherein said scale factor estimation unit further adjusts the quantizable audio intensity of each of the frequency sub-bands in the current audio frame according to position of the corresponding frequency sub-band in the current audio frame in the spectrum.

8. The audio encoding apparatus as claimed in claim 7, wherein said scale factor estimation unit estimates the scale factor for each of the frequency sub-bands in the current audio frame according to the following equations:

$$SF=-16/3[C_1 \log_2(X')+C_2 \log_2(X_{max})]$$

and $X'=f(X^{3/4})$ where Xmax is the quantizable audio intensity; C1 and C2 are constant parameters; X is a vector representing the intensity of each signal in the corresponding frequency sub-band; and is a maximum of absolute values of the intensities of the signals in the corresponding frequency sub-band to the power of ¾.

9. The audio encoding apparatus as claimed in claim 7, wherein said scale factor estimation unit estimates the scale factor for each of the frequency sub-bands in the current audio frame according to the following equations:

$$SF = -\frac{16}{3}[C_1 \log_2(X') + C_2 \log_2(X_{\max})]$$

and $X' = f(X^{3/4})$ where Xmax is the quantizable audio intensity; C1 and C2 are constant parameters; X is a vector representing the intensity of each signal in the corresponding frequency sub-band; and is a mean of absolute values of the intensities of the signals in the corresponding frequency sub-band to the power of ¾.

10. The audio encoding apparatus as claimed in claim 7, wherein:

when the cumulative total buffer utilization amount space is greater than a predicted cumulative amount for the current audio frame, and when the amount of buffer space used for storing the previously encoded audio frame in said buffer unit is higher than an average amount of buffer space usable for storing a single encoded audio frame, said scale factor estimation unit down-adjusts the quantizable audio intensity so as to reduce the amount of buffer space used for the current audio frame;

when the cumulative total buffer utilization amount is greater than the predicted cumulative amount, and when the amount of buffer space used for storing the previously encoded audio frame in said buffer unit is lower than the average amount of buffer space usable for storing a single encoded audio frame, said scale factor estimation unit does not adjust the quantizable audio intensity;

when the cumulative total buffer utilization amount is less than the predicted cumulative amount, and when the amount of buffer space used for storing the previously encoded audio frame in said buffer unit is lower than the average amount of buffer space usable for storing a single encoded audio frame, said scale factor estimation unit up-adjusts the quantizable audio intensity so as to increase the amount of buffer space used for the current audio frame;

when the cumulative total buffer utilization amount is less than the predicted cumulative amount, and when the amount of buffer space used for storing the previously encoded audio frame in said buffer unit is higher than the average amount of buffer space usable for storing a single encoded audio frame, said scale factor estimation unit does not adjust the quantizable audio intensity;

said scale factor estimation unit up-adjusts the quantizable audio intensity when the mean of the intensities of all the signals in the corresponding frequency sub-band in the current audio frame is large, and down-adjusts the quantizable audio intensity when otherwise; and said scale factor estimation units up-adjusts the quantizable audio intensity when the corresponding frequency sub-band in the current audio frame is located at a forward position in the spectrum and belongs to a relatively low frequency signal, and down-adjusts the quantizable audio intensity when otherwise.

11. The audio encoding apparatus as claimed in claim 10, wherein said scale factor estimation unit estimates the scale factor for each of the frequency sub-bands in the current audio frame according to the following equations:

$$SF = -\frac{16}{3}[C_1\log_2(X') + C_2\log_2(X_{\max})]$$

$$\text{and } X' = f(X^{3/4})$$

where Xmax is the quantizable audio intensity; C1 and C2 are constant parameters; X is a vector representing the intensity of each signal in the corresponding frequency sub-band; and is a maximum of absolute values of the intensities of the signals in the corresponding frequency sub-band to the power ¾.

12. The audio encoding apparatus as claimed in claim 10, wherein said scale factor estimation unit estimates the scale factor for each of the frequency sub-bands in the current audio frame according to the following equations:

$$SF = -\frac{16}{3}[C_1\log_2(X') + C_2\log_2(X_{\max})]$$

$$\text{and } X' = f(X^{3/4})$$

where Xmax is the quantizable audio intensity; C1 and C2 are constant parameters; X is a vector representing the intensity of each signal in the corresponding frequency sub-band; and is a mean of absolute values of the intensities of the signals in the corresponding frequency sub-band to the power of ¾.

13. The audio encoding apparatus as claimed in claim 1, wherein said scale factor estimation unit further adjusts the quantizable audio intensity of each of the frequency sub-bands in the current audio frame according to position of the corresponding frequency sub-band in the current audio frame in the spectrum.

14. The audio encoding apparatus as claimed in claim 13, wherein said scale factor estimation unit up-adjusts the quantizable audio intensity when the corresponding frequency sub-band in the current audio frame is located at a forward position in the spectrum and belongs to a relatively low frequency signal.

15. The audio encoding apparatus as claimed in claim 13, wherein said scale factor estimation unit down-adjusts the quantizable audio intensity when the corresponding frequency sub-band in the current audio frame is not located at a forward position in the spectrum and does not belong to a relatively low frequency signal.

16. The audio encoding apparatus as claimed in claim 2, wherein said transform module adopts modified discrete cosine transform for transforming the audio frame.

17. A method for audio encoding adapted for encoding an audio frame into an audio stream, said method comprising:

analyzing an audio frame using a psychoacoustic model so as to obtain a corresponding masking curve and window information;

transforming the audio frame from the time domain to the frequency domain based on the window information so as to obtain a spectrum of the audio frame, and dividing the spectrum into a plurality of frequency sub-bands;

estimating directly a scale factor for each of the frequency sub-bands in the audio frame;

quantizing each of the frequency sub-bands according to the scale factor thereof;

encoding the quantized frequency sub-bands; and packing the encoded frequency sub-bands and side information into the audio stream, wherein the step of estimating the scale factor for each of the frequency sub-bands in the audio frame includes:

adjusting a quantizable audio intensity of each of the frequency sub-bands in a current audio frame according to a cumulative total buffer utilization amount, which is the total amount of buffer space that has been used thus far for storing the encoded frequency sub-bands in a buffer unit at an encoding end, and an amount of buffer space used for storing a previously encoded audio frame in the buffer unit; and estimating the scale factor for each of the frequency sub-bands in the current audio frame according to finally adjusted quantizable audio intensities of the frequency sub-bands in the current audio frame.

18. The method for audio encoding as claimed in claim 17, wherein:

the quantizable audio intensity Is down-adjusted so as to reduce the amount of buffer space used for the current audio frame when the cumulative total buffer utilization amount is greater than a predicted cumulative amount for the current audio frame, and when the amount of buffer space used for storing the previously encoded audio frame in the buffer unit is higher than an average amount of buffer space usable for storing a single encoded audio frame; and the quantizable audio intensity is not adjusted when the cumulative total buffer utilization amount is greater than the predicted cumulative amount, and when the amount of buffer space used for storing the previously encoded audio frame in the buffer unit is lower than the average amount of buffer space usable for storing a single encoded audio frame.

19. The method for audio encoding as claimed in claim 17, wherein:

the quantizable audio intensity is up-adjusted so as to increase the amount of buffer space used for the current audio frame when the cumulative total buffer utilization amount is less than a predicted cumulative amount for the current audio frame, and when the amount of buffer space used for storing the previously encoded audio frame in the buffer unit is lower than an average amount of buffer space usable for storing a single encoded audio frame; and the quantizable audio intensity is not adjusted when the cumulative total buffer utilization amount is less than the predicted cumulative amount, and when the amount of buffer space used for storing the previously encoded audio frame in the buffer unit is higher than the average amount of buffer space usable for storing a single encoded audio frame.

20. The method for audio encoding as claimed in claim 17, wherein, in the step of estimating the scale factor for each of the frequency sub-bands in the audio frame, the quantizable audio intensity of each of the frequency sub-bands in the current audio frame is further adjusted according to a mean of the intensities of all signals in the corresponding frequency sub-band in the current audio frame.

21. The method for audio encoding as claimed in claim 20, wherein the quantizable audio intensity is up-adjusted when the mean of the intensities of all signals in the corresponding frequency sub-band in the current audio frame is large.

22. The method for audio encoding as claimed in claim 20, wherein the quantizable audio intensity is down-adjusted when the mean of the intensities of all signals in the corresponding frequency sub-band in the current audio frame is not large.

23. The method for audio encoding as claimed in claim 20 wherein, in the step of estimating the scale factor for each of the frequency sub-bands in the audio frame, the quantizable audio intensity of each of the frequency sub-bands in the current audio frame is further adjusted according to position of the corresponding frequency sub-band in the current audio frame in the spectrum.

24. The method for audio encoding as claimed in claim 23, wherein the scale factor for each of the frequency sub-bands in the current audio frame is estimated according to the following equations:

$$SF = -\frac{16}{3}[C_1\log_2(X') + C_2\log_2(X_{\max})]$$

$$\text{and } X' = f(X^{3/4})$$

where Xmax is the quantizable audio intensity; C1 and C2 are constant parameters; X is a vector representing the intensity of each signal in the corresponding frequency sub-band, and is a maximum of absolute values of the intensities of the signals in the corresponding frequency sub-band to the power of ¾.

25. The method for audio encoding as claimed in claim 23, wherein the scale factor for each of the frequency sub-bands in the current audio frame is estimated according to the following equations:

$$SF = -\frac{16}{3}[C_1\log_2(X') + C_2\log_2(X_{\max})]$$

$$\text{and } X' = f(X^{3/4})$$

where Xmax is the quantizable audio intensity; C1 and C2 are constant parameters; X is a vector representing the intensity of each signal in the corresponding frequency sub-band; and is a mean of absolute values of the intensities of the signals in the corresponding frequency sub-band to the power of ¾.

26. The method for audio encoding as claimed in claim 23, wherein:

when the cumulative total buffer utilization amount is greater than a predicted cumulative amount for the current audio frame, and when the amount of buffer space used for storing the previously encoded audio frame in the buffer unit is higher than an average amount of buffer space usable for storing a single encoded audio frame, the quantizable audio intensity is down-adjusted so as to reduce the amount of buffer space used for the current audio frame;

when the cumulative total buffer utilization amount is greater than the predicted cumulative amount, and when the amount of buffer space used for storing the previously encoded audio frame in the buffer unit is lower than the average amount of buffer space usable for storing a single encoded audio frame, the quantizable audio intensity is not adjusted;

when the cumulative total buffer utilization amount is less than the predicted cumulative amount, and when the amount of buffer space used for storing the previously encoded audio frame in the buffer unit is lower than the average amount of buffer space usable for storing a single encoded audio frame, the quantizable audio intensity is up-adjusted so as to reduce the amount of buffer space used for the current audio frame;

when the cumulative total buffer utilization amount is less than the predicted cumulative amount, and when the amount of buffer space used for storing the previously encoded audio frame in the buffer unit is higher than the average amount of buffer space usable for storing a single encoded audio frame, the quantizable audio intensity is not adjusted;

the quantizable audio intensity is up-adjusted when the mean of the intensities of all signals in the corresponding frequency sub-band in the current audio frame is large, and is down-adjusted when otherwise; and the quantizable audio intensity is up-adjusted when the corresponding frequency sub-band in the current audio frame is located at a forward position in the spectrum and belongs to a relatively low frequency signal, and is down-adjusted when otherwise.

27. The method for audio encoding as claimed in claim 26, wherein the scale factor for each of the frequency sub-bands in the current audio frame is estimated according to the following equations:

$$SF = -\frac{16}{3}[C_1\log_2(X') + C_2\log_2(X_{\max})]$$

$$\text{and } X' = f(X^{3/4})$$

where Xmax is the quantizable audio intensity; C1 and C2 are constant parameters; X is a vector representing the intensity of each signal in the corresponding frequency sub-band; and is a maximum of absolute values of the intensities of the signals in the corresponding frequency sub-band to the power ¾.

28. The method for audio encoding as claimed in claim 26, wherein the scale factor for each of the frequency sub-bands in the current audio frame is estimated according to the following equations:

$$SF = -\frac{16}{3}[C_1\log_2(X') + C_2\log_2(X_{\max})]$$

$$\text{and } X' = f(X^{3/4})$$

where Xmax is the quantizable audio intensity; C1 and C2 are constant parameters; X is a vector representing the intensity of each signal in the corresponding frequency sub-band; and is a mean of absolute values of the intensities of the signals in the corresponding frequency sub-tend to the power of ¾.

29. The method for audio encoding as claimed in claim 17, wherein, in the step of estimating the scale factor for each of the frequency sub-bands in the audio frame, the quantizable audio intensity of each of the frequency sub-bands in the current audio frame is further adjusted according to position of the corresponding frequency sub-band in the current audio frame in the spectrum.

30. The method for audio encoding as claimed in claim 29, wherein the quantizable audio intensity is up-adjusted when the corresponding frequency sub-band in the current audio frame is located at a forward position in the spectrum and belongs to a relatively low frequency signal.

31. The method for audio encoding as claimed in claim 29, wherein the quantizable audio intensity is down-adjusted when the corresponding frequency sub-band in the current audio frame is not located at a forward position in the spectrum and does not belong to a relatively low frequency signal.

32. The method for audio encoding as claimed in claim 17, wherein the audio frame is transformed from the time domain to the frequency domain using modified discrete cosine transform.

* * * * *